US008188832B2

(12) United States Patent
Das et al.

(10) Patent No.: US 8,188,832 B2
(45) Date of Patent: May 29, 2012

(54) NEAR ZERO TCR RESISTOR CONFIGURATIONS

(75) Inventors: Amitabh Das, State College, PA (US); Robert J. Hufnagel, Port Matilda, PA (US); Christopher R. Grabbe, Pennsylvania Furnace, PA (US)

(73) Assignee: State of the Art, Inc., State College, PA (US)

( * ) Notice: Subject to any disclaimer, the term of this patent is extended or adjusted under 35 U.S.C. 154(b) by 86 days.

(21) Appl. No.: 12/774,294

(22) Filed: May 5, 2010

(65) Prior Publication Data

US 2011/0273263 A1 Nov. 10, 2011

(51) Int. Cl.
*H01C 7/06* (2006.01)

(52) U.S. Cl. ..... 338/7

(58) Field of Classification Search ..... 338/7
See application file for complete search history.

(56) References Cited

U.S. PATENT DOCUMENTS 4,104,607 A 8/1978 Jones
5,057,674 A * 10/1991 Smith-Johannsen ..... 219/553
5,332,981 A 7/1994 Mazzochette et al.
6,400,251 B1 * 6/2002 Abe et al. ..... 338/22 R
6,890,810 B2 5/2005 Amadon et al.
7,215,219 B2 * 5/2007 Roldan et al. ..... 333/81 A
7,224,258 B2 * 5/2007 Barge et al. ..... 338/307
7,345,573 B2 * 3/2008 Beach ..... 338/9
7,362,196 B2 4/2008 Yan et al.
7,528,677 B2 5/2009 Yan et al.
7,659,176 B2 * 2/2010 Coolbaugh et al. ..... 438/385
7,704,871 B2 * 4/2010 Beach ..... 438/620
2010/0194522 A1 * 8/2010 Janning ..... 338/22 R
2011/0037559 A1 * 2/2011 Block et al. ..... 338/21
2011/0273263 A1 * 11/2011 Das et al. ..... 338/7

* cited by examiner

*Primary Examiner* — James Harvey
(74) *Attorney, Agent, or Firm* — Dann, Dorfman, Herrell and Skillman, P.C.

(57) ABSTRACT

A microchip resistor device is disclosed in which first and second resistive elements are formed on a substrate. The first resistive element has a first resistance value and a positive temperature coefficient of resistance (TCR) over a selected temperature range. The second resistive element has a second resistance value and a negative TCR over the selected temperature range. The first and second resistive elements do not overlap each other. The first and second resistive elements are operatively connected with one or more conductors to provide a current path between the two elements. The product of the first resistance value and the positive temperature coefficient of resistance is substantially equal in magnitude to the product of the second resistance value and the negative temperature coefficient of resistance.

10 Claims, 6 Drawing Sheets

NEAR ZERO TCR RESISTOR CONFIGURATIONS

BACKGROUND OF THE INVENTION

1. Field of the Invention

The invention relates generally to resistive chip devices for electronic systems. In particular, the invention relates to a resistor device that provides only a minimal variation in resistance over an operating temperature range.

2. Description of the Related Art

A resistor is designed to produce a voltage across its terminals proportional to the electric current that passes through it. Resistors are used in nearly every kind of electronic equipment available today. For many types of resistive materials, their resistivity can change significantly as the ambient temperature changes. When such variations occur, electrical equipment in which the resistive device is employed may not perform as accurately as necessary, or may fail entirely. It has also been found in working with composite resistor films, that the properties of such films change after they are temperature treated or annealed. This change is not always predictable because of variations in the resistive material on a microscopic scale, caused by an interdiffusion of the two materials during high-temperature treatments that can affect the sheet resistance and the temperature coefficient of resistance of the resistive thin film material. Known devices designed to counteract this effect have disadvantages. They are typically made from cermet alloys or metallic alloy foils. Cermet alloys cannot achieve precisely controlled temperature coefficient of resistance values. Metallic alloy foils, on the other hand, cannot achieve high resistance values.

It would be desirable to have a resistor device that has both precise temperature coefficients of resistance and is able to achieve high resistance values. Such a device would allow electronic devices to operate without significant effect from changes in ambient temperature conditions and would allow the devices to be more reliable and precise in use.

SUMMARY OF THE INVENTION

In accordance with one aspect of the present invention there is provided a microchip resistor that includes a substrate formed of a dielectric material. A first resistive element is formed on the substrate. The first resistive element has a first resistance value and a positive temperature coefficient of resistance (TCR) over a selected temperature range. The device also has a second resistive element formed on the substrate which has a second resistance value and a negative temperature coefficient of resistance over the selected temperature range. The first and second resistive elements do not overlap each other. A conductive element is operatively connected to the first resistive element and to the second electrically resistive element to provide a current path between the two elements. The product of the first resistance value and the positive TCR is substantially equal in magnitude to the product of the second resistance value and the negative TCR.

In accordance with a second aspect of the present invention there is provided a microchip device that includes a substrate formed of a dielectric material. A first resistive element is formed on the substrate. The first resistive element has a first resistance value and a positive TCR over a selected temperature range. A second resistive element is formed on the substrate without overlapping the first resistive element. The second resistive element has a second resistance value and a negative TCR over the selected temperature range. The device further includes a first conductive element operatively connected to the first resistive element and to the second resistive element. A second conductive element is operatively connected to the first resistive element and to the second resistive element. The first and second conductive elements are connected to the first and second resistive elements such that the first and second resistive elements are connected in parallel. The product of the first resistance value and the negative TCR is substantially equal in magnitude to the product of the second resistance value and the positive TCR.

Here and throughout this specification the terms "resistor", "resistive", "resistance", or "resistivity" are interpreted to mean an electric resistor, electrically resistive, electrical resistance, or electrical resistivity, respectively. The terms "conductor", "conductive", "conductance", or "conductivity" are interpreted to mean an electric conductor, electrically conductive, electrical conductance, or electrical conductivity, respectively. Moreover, the terms "conductor", "conductive", "conductance", or "conductivity" also have the connotation of the lack of any effective resistance to the flow of electric current.

DETAILED DESCRIPTION

Figure 1:
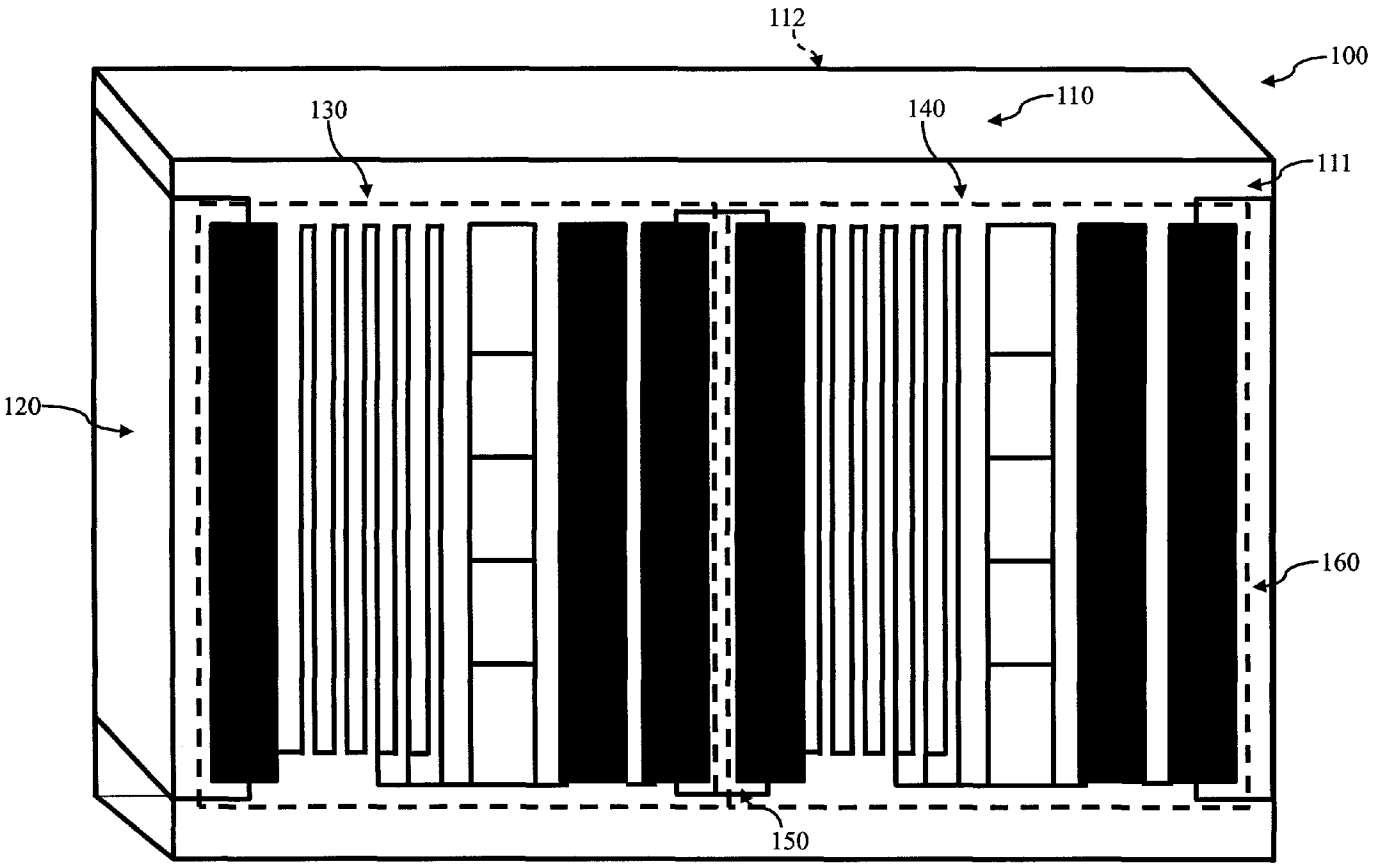
FIG. 1 is a front perspective view of a first embodiment of a resistor device according to the present invention.
Figure 2:
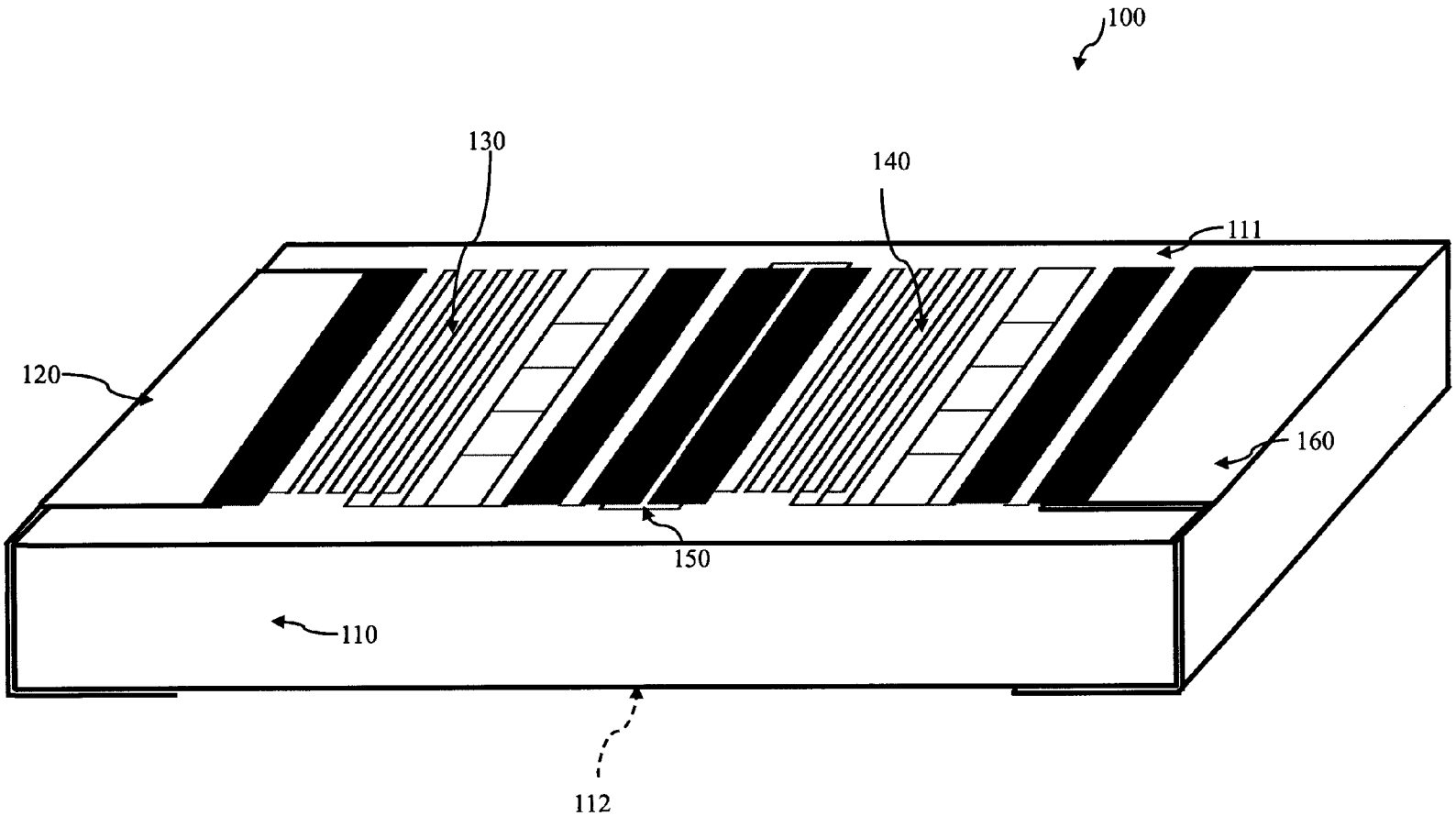
FIG. 2 is a side perspective view of the resistor device of FIG. 1.

The resistor device in accordance with the present invention is a device that provides resistance to an electrical current input while minimizing the variation in the resistance of the device in response to changes in temperature or reactions between resistor materials. Referring now to the drawings, and in particular to FIGS. 1 and 2, there is shown a first embodiment of a resistor device according to this invention. Device 100 has a substrate 110 that has a front surface 111 and a rear surface 112. The substrate is preferably formed of a dielectric material such as alumina. It will be appreciated by those skilled in the art that the substrate may also be formed of other dielectric materials such as aluminum nitride, silica, beryllium oxide, or a glass-ceramic composite.

A first resistive element 130 and a second resistive element 140 are formed on the surface 111 of the dielectric substrate 110. The first and second resistive elements are substantially co-planar, but do not overlap each other to any significant degree. Preferably, they do not overlap at all. A first wraparound terminal connector 120 is provided at a first end of the substrate 110 such that resistive element 130 is in conductive communication with the first wraparound connector 120. A second wrap-around terminal connector 160 is provided at a second end of the substrate 110. Preferably, the first and second wrap-around connectors are disposed at opposing ends of the substrate 110. The second resistive element 140 is in conductive communication with second wraparound connector 160. Intermediate conductor 150 connects resistive elements 130 and 140 in series. The first and second wrap-around connectors 120, 160, provide terminals for interconnecting the resistive device 100 with other components. While two resistive elements formed on the surface of the device are described, it is contemplated that a plurality of such resistive elements could be used to provide various configurations. Resistive elements 130 and 140 are preferably formed of different materials with different resistance properties. The materials used to form the resistive elements 130 and 140 are selected such that the TCR of resistive element 130 is related to the TCR of resistive element 140. Preferably, resistive element 130 is composed of a material that exhibits a reproducible negative TCR over a desired temperature range. A usual temperature range of interest is about −55° C. to about +125° C. (−67° F. to +257° F.). The preferred temperature range encompasses the normal ambient temperature range that the resistive device would be expected to encounter during use in electronic equipment. Resistive element 140 is composed of a material that exhibits a reproducible positive TCR over the same temperature range. Commonly utilized materials such as TaN, NiCr, SiOCr, or RuNb may comprise the resistive elements of the device. Other materials known to one skilled in the art may also be used. Likewise, the conductive elements of the device may be printed with materials commonly utilized for conductors, such as silver paladium (AgPd) or gold, or any other material known to one skilled in the art.

The arrangement described and shown in FIGS. 1 and 2 has the resistive elements 130 and 140 connected in series. Each of the resistive elements 130 and 140 is trimmed to provide a specific resistance value such that the combination of the resistive elements provides a desired overall resistance value that is the sum of the resistance values of each of the resistive elements. The product of the resistance and the TCR for resistive element 130 has a magnitude that is equal to or substantially equal to the magnitude of the product of the resistance and the TCR for resistive element 140. This configuration results in a total resistance with a TCR of zero in value or near-zero in value because of the inverse relationship of the TCR's of the two resistive materials. Consequently, the overall resistance of the device 100 does not vary significantly over the temperature range of interest. Each of the resistive elements 130 and 140 is trimmed to provide a desired resistance value to provide a variety of overall resistance values. Referring now to FIG. 2, a side perspective of the resistor device of FIG. 1 is shown. This perspective illustrates the placement of the wraparound terminals 120 and 160. An electrical current can be provided to terminal 120, where it then passes through resistor 130, through connector 150, and through resistor 140. From there, it passes to terminal 160, where the modified electrical signal is output to another device or component. The wrap-around design of the terminals permits the device to be inserted into a cavity and have the signal lines leading to the input and output contacts attached with ribbon bonds. Alternatively, the wrap-around connectors would directly connect with mating contacts on the circuit board.

Figure 3:
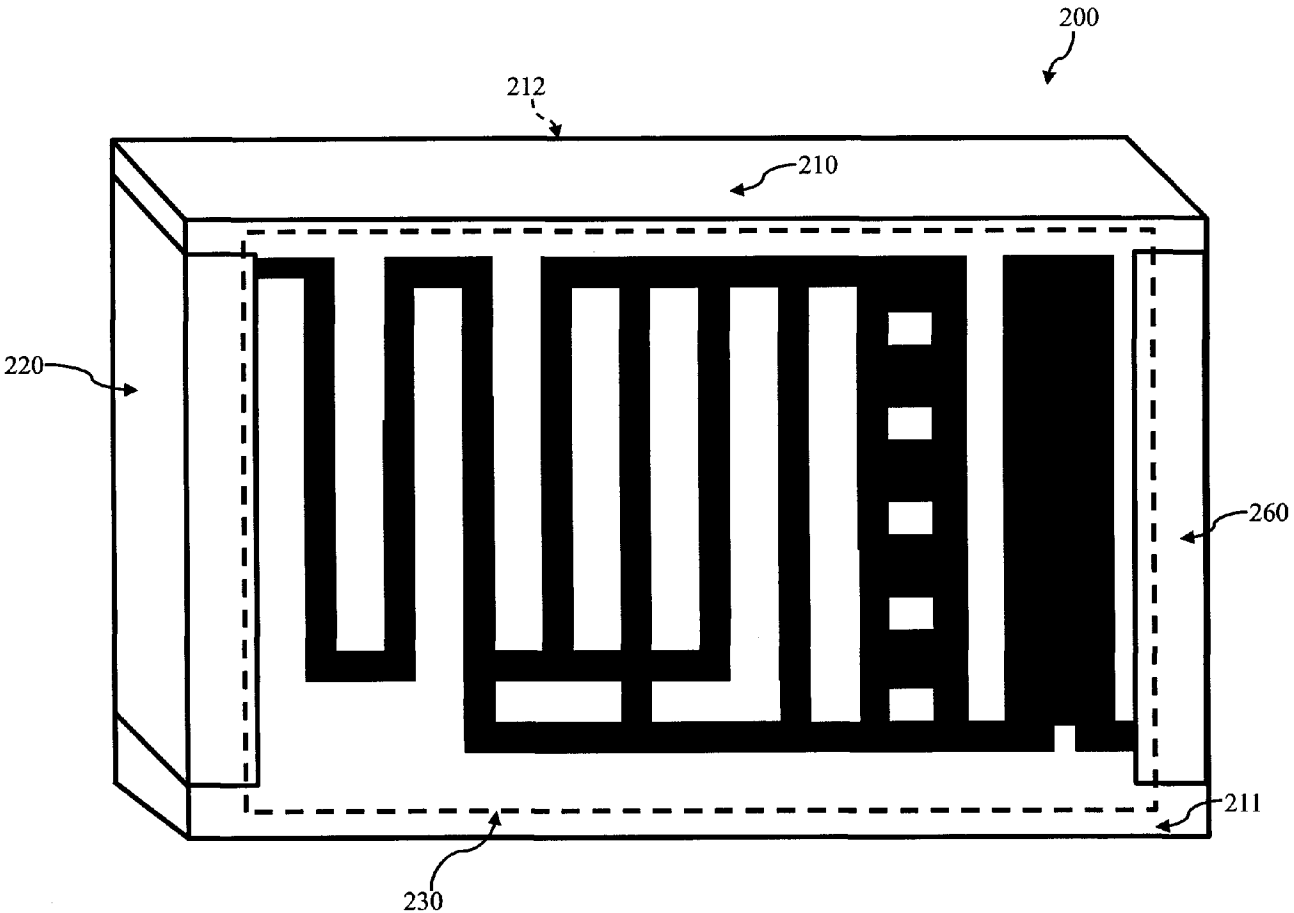
FIG. 3 is a front perspective view of a second embodiment of a resistor device according to the present invention.
Figure 4:
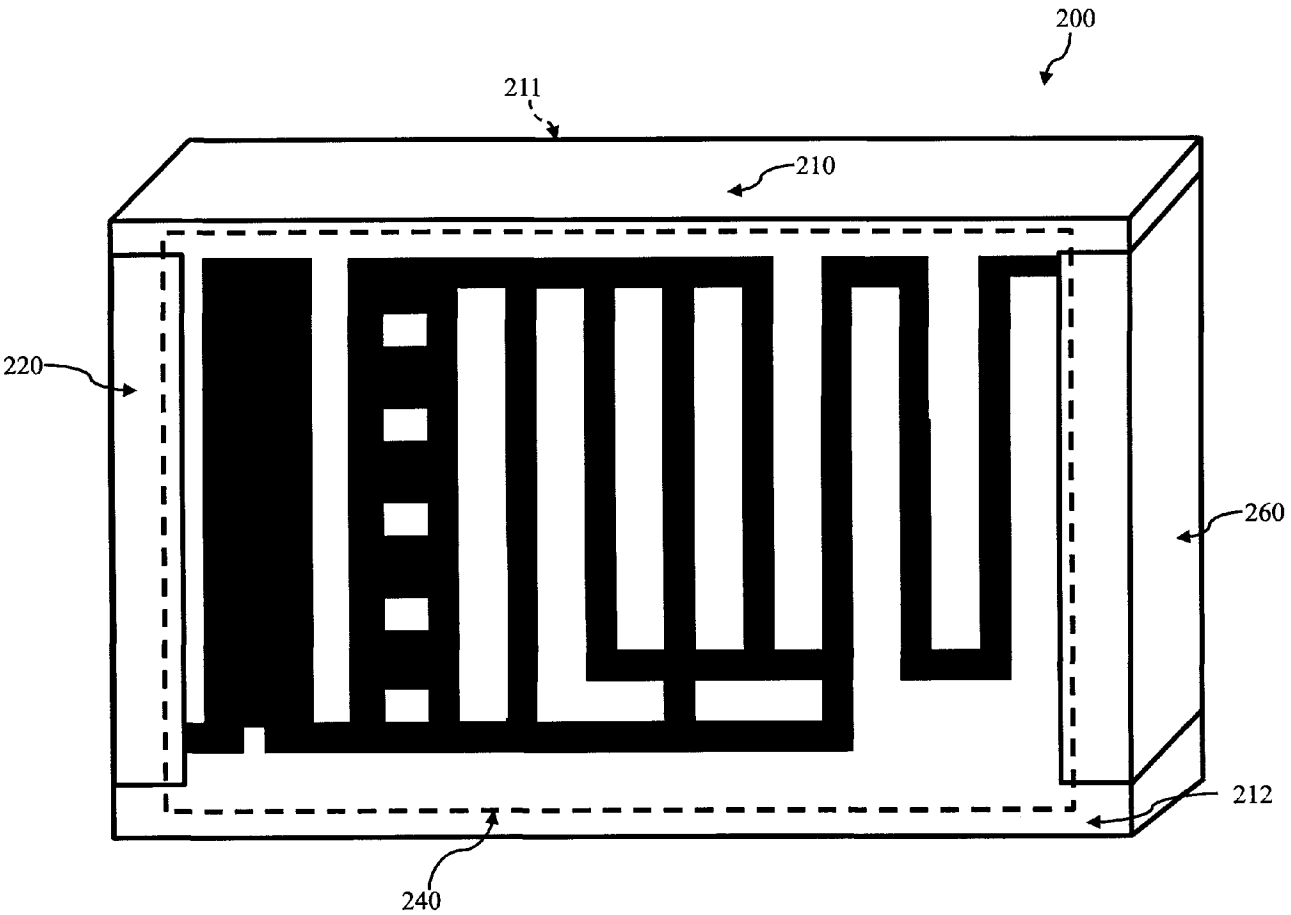
FIG. 4 is rear perspective view of the resistor device of FIG. 3.

Referring now to FIG. 3, a second embodiment of a resistor device according to the invention is shown. Device 200 has a substrate 210 that has a front surface 211 and a rear surface 212. The substrate is preferably formed of a dielectric material, preferably a ceramic material such as alumina, aluminum nitride, silica, beryllium oxide, or a glass-ceramic composite. Wrap-around connector-terminals 220 and 260 are disposed at opposing ends of the substrate. Resistive element 230 is formed on front surface 211 and is conductively connected to both wrap-around connector-terminal 220 and wrap-around connector-terminal 260. FIG. 4 shows the rear surface 212 of device 200. Resistive element 240 is formed on rear surface 212 of device 200. Resistive element 240 is in conductive communication with both wrap-around connector-terminals 220 and 260. In this arrangement the resistive elements 230 and 240 are connected in parallel. The formula for the effective resistance of resistors connected in parallel is $R_{total}=(R_1*R_2)/(R_1+R_2)$. In order to make the effective TCR of the device 200 near zero, the magnitude of the product of the resistance of the first resistive element 230 and the TCR of the second resistive element 240 should be equal to or nearly equal to the magnitude of the product of the resistance of the second resistive element 240 and the TCR of the first resistive element. The other properties of the two resistors should otherwise be similar to the properties of resistive elements 130 and 140 of device 100 as described above.

Figure 5:
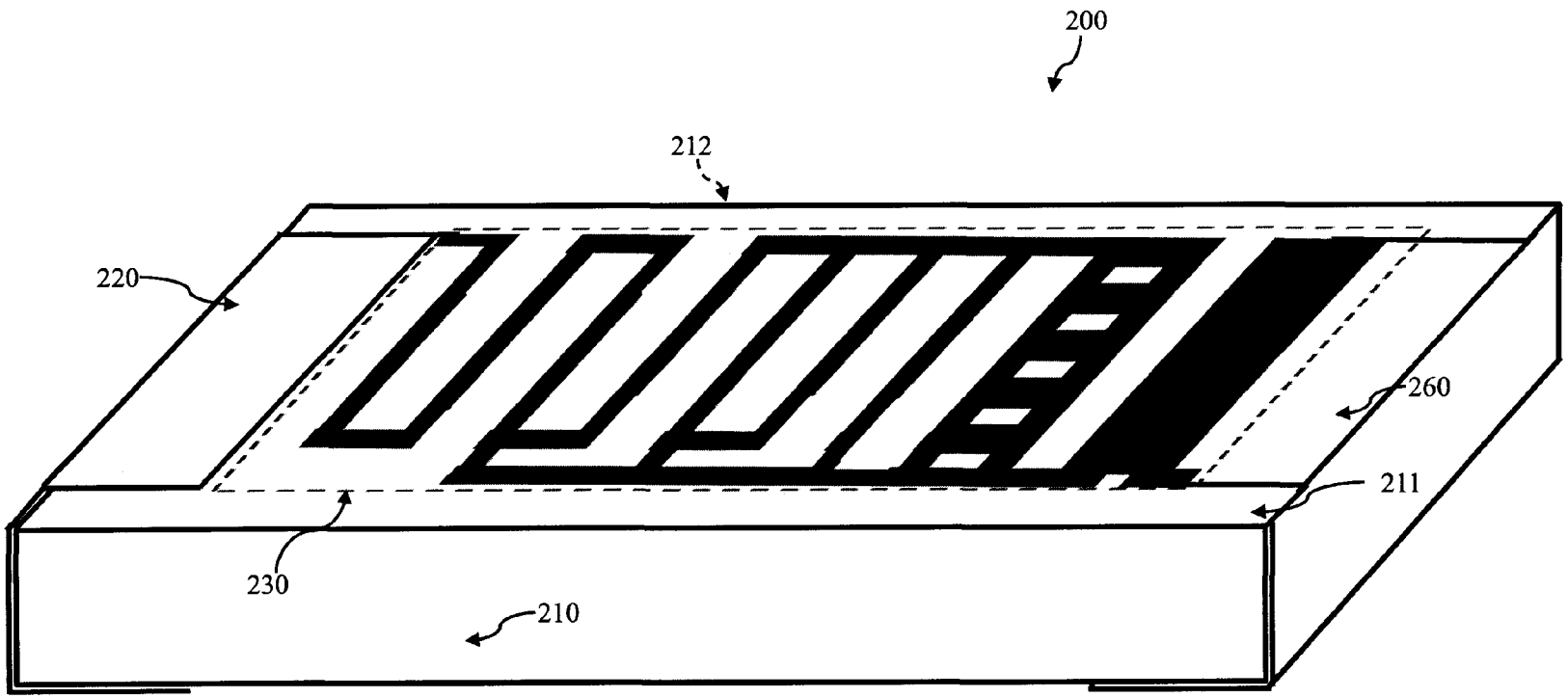
FIG. 5 is a side perspective view of the resistor device of FIG. 3.

Referring now to FIG. 5, a further perspective view of the embodiment of FIG. 3 is shown. This view illustrates the placement and construction of the wrap-around connector terminals 220 and 260 on device 200. In addition to functioning as connection points for connecting the resistor device 200 to other components, the connector-terminals also interconnect the resistive elements 230 and 240.

Figure 6:
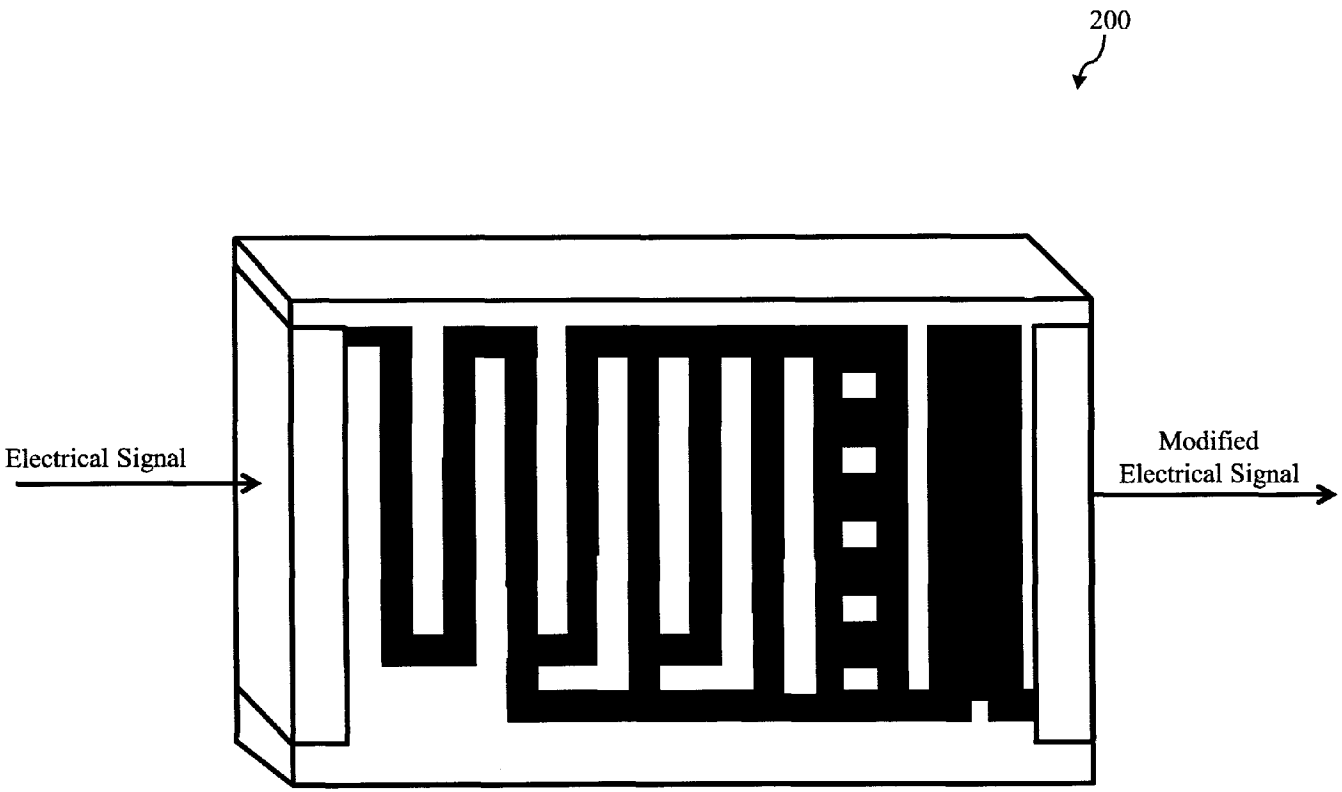
FIG. 6 is a schematic diagram illustrating a resistor device according to the present invention in use.

Referring now to FIG. 6, an application of the invention is shown schematically. An electrical signal is provided to wrap-around connector-terminal. This electrical signal is conducted across the resistive elements formed on the surface or surfaces of the substrate. The signal is then conducted to the other wrap-around connector-terminal in its modified state, where it is then output to another component.

Modifications to the foregoing embodiments contemplated by the inventors to be within the scope of the invention include combining serial and parallel configurations on a single device, configuring the resistors in parallel on a single side of the substrate, having more than two resistors in either series or parallel, or modifying the TCR of the device by printing each resistor with a TCR of the same sign (positive or negative). Other modifications, such as printing the resistors with varying sheet resistance, are also contemplated. It is also understood that the positive TCR resistive element(s) and the negative TCR resistive element(s) need not be arranged in any particular order. Further, the resistive elements can be trimmed to different resistance values within their respective trim ranges.

A method for making a near-zero TCR resistor chip device in accordance with this invention will now be described. The process begins with the selection of an appropriate substrate material. Although the preferred substrate material is alumina, other dielectric materials can be used. In this regard, ceramic materials such as aluminum nitride, silica, beryllium oxide, and glass-ceramic composites are suitable.

A layer of electrically resistive material is deposited on a surface of the substrate. Next, a plurality of layers of electrically conductive material are deposited over the resistive layer. The resistive and conductive layers are preferably deposited as thin films. The deposition steps are performed in a vacuum. A photo-sensitive material known as a photoresist is spin-coated onto the multiple layers. An etch pattern is formed on the photoresist using ultraviolet (uv) lithography, a known technique. The metallic layers are then etched through the patterned photoresist to form the contacts and conductive paths of the chip device. The photoresist is then stripped away and a new coating of photoresist is applied. The second photoresist coating is patterned, again using uv lithography. The resistive material is then dry etched through the openings in the pattern to form the geometries of the resistive elements for each chip. The dry etching is preferably performed by an ion milling technique. The remaining photoresist is then removed.

The resistive elements are trimmed to final value by any known technique, preferably by laser trimming. Preferably, the chip device is passivated with a polymer to protect it from contamination or physical damage. The substrate is then scored with a laser and separated into individual chip devices.

As the chip resistors are designed to operate at high temperatures, a method of temperature treating them is desirable. The devices, once printed, are annealed to approximately 400 degrees Celsius to lock in the temperature coefficient of resistance and sheet resistance at lower temperatures. This process, commonly used in the manufacture of thin film resistors, is well known to those skilled in the art.

Although the preferred process has been described as including thin film techniques, the inventors believe that the resistor device according to this invention can be made by thick film printing techniques also. In the case of thick film technology, the substrate is scored or scribed using a laser. Then the conductor patterns are screen printed and sintered onto the substrate surface. Then the resistor patterns are screen printed onto the substrate. A plurality of inks may be used depending on the resistance and TCR values desired.

The foregoing descriptions are also directed to embodiments of a near-zero TCR resistor device in accordance with the present invention which can be used alone or as a building blocks for more complex devices. Thus, the inventors contemplate that the various embodiments described may be modified or combined as needed to provide desired levels of resistance for a particular application while still providing a near-zero TCR.

The descriptions presented above are also directed to particular embodiments of a near-zero TCR resistor device in accordance with the present invention. It will be recognized by those skilled in the art that changes or modifications may be made to the above-described embodiments without departing from the broad inventive concepts of the invention. It is understood, therefore, that the invention is not limited to the particular embodiments that are described, but is intended to cover all modifications and changes within the scope and spirit of the invention as described above and set forth in the appended claims.

The invention claimed is:

1. A microchip resistor comprising:

a substrate formed of a dielectric material;

a first resistive element formed on said substrate, said first resistive element having a first resistance value and a positive temperature coefficient of resistance over a selected temperature range;

a second resistive element formed on said substrate without overlapping said first resistive element, said second resistive element having a second resistance value and a negative temperature coefficient of resistance over the selected temperature range; and a conductor operatively connected to said first resistive element and to said second resistive element;

wherein the magnitude of the product of the first resistance value and the positive temperature coefficient of resistance is substantially equal to the magnitude of the product of the second resistance value and the negative temperature coefficient of resistance.

2. A microchip resistor as claimed in claim 1 comprising:

a first terminal connector formed of conductive material and connected to said first resistive element; and a second terminal connector formed of conductive material and connected to said second resistive element;

wherein the first and second resistive elements are connected in series.

3. A microchip resistor as claimed in claim 2 wherein said substrate has first a front surface and a rear surface and the first and second resistive element are formed on the front surface.

4. A microchip resistor comprising:

a substrate formed of a dielectric material;

a first resistive element formed on said substrate, said first resistive element having a first resistance value and a positive temperature coefficient of resistance over a selected temperature range;

a second resistive element formed on said substrate without overlapping said first resistive element, said second resistive element having a second resistance value and a negative temperature coefficient of resistance over the selected temperature range;

a first conductor operatively connected to said first resistive element and to said second resistive element; and a second conductor operatively connected to said first resistive element and to said second resistive element;

wherein the substrate has a front surface and a rear surface and wherein the first resistive element is formed on the front surface and the second resistive element is formed on the rear surface.

wherein said first and second conductors are connected to the first and second resistive elements such that said first and second resistive elements are connected in parallel; and wherein the magnitude of the product of the first resistance value and the negative temperature coefficient of resistance is substantially equal to the magnitude of the product of the second resistance value and the positive temperature coefficient of resistance.

5. A microchip resistor as claimed in claim 4 wherein the first conductor is wrapped around a first end of the substrate and the second conductor is around a second end of the substrate.

6. A microchip resistor as claimed in claim 1 comprising a second conductor operatively connected to said first resistive element and to said second resistive element such that said first and second resistive elements are connected in parallel.

7. A microchip resistor comprising:

a substrate formed of a dielectric material;

a first resistive element formed on said substrate, said first resistive element having a first resistance value and a positive temperature coefficient of resistance over a selected temperature range;

a second resistive element formed on said substrate without overlapping said first resistive element, said second resistive element having a second resistance value and a negative temperature coefficient of resistance over the selected temperature range;

a first conductor operatively connected to said first resistive element and to said second resistive element; and a second conductor operatively connected to said first resistive element and to said second resistive element;

wherein said first and second conductors are connected to the first and second resistive elements such that said first and second resistive elements are connected in parallel; and wherein the magnitude of the product of the first resistance value and the negative temperature coefficient of resistance is substantially equal to the magnitude of the product of the second resistance value and the positive temperature coefficient of resistance.

8. A microchip resistor as claimed in claim 7 wherein the substrate has a front surface and a rear surface and wherein the first resistive element is formed on the front surface and the second resistive element is formed on the rear surface.

9. A microchip resistor as claimed in claim 8 wherein the first conductor is wrapped around a first end of the substrate and the second conductor is wrapped around a second end of the substrate.

10. A microchip resistor as claimed in claim 1 wherein the first resistive element and the second resistive element are coplanar.

* * * * *